US008901834B2

(12) United States Patent
Frias, Sr.

(10) Patent No.: US 8,901,834 B2
(45) Date of Patent: Dec. 2, 2014

(54) RECONFIGURABLE LED ARRAYS AND LIGHTING FIXTURES

(71) Applicant: Jacobo Frias, Sr., Bronx, NY (US)

(72) Inventor: Jacobo Frias, Sr., Bronx, NY (US)

( * ) Notice: Subject to any disclaimer, the term of this patent is extended or adjusted under 35 U.S.C. 154(b) by 188 days.

(21) Appl. No.: 13/741,479

(22) Filed: Jan. 15, 2013

(65) Prior Publication Data

US 2013/0181621 A1 Jul. 18, 2013

Related U.S. Application Data

(62) Division of application No. 13/682,330, filed on Nov. 20, 2012.

(60) Provisional application No. 61/587,106, filed on Jan. 16, 2012.

(51) Int. Cl.
*H05B 37/02* (2006.01)
*H05B 37/00* (2006.01)

(52) U.S. Cl.
CPC ..... *H05B 37/00* (2013.01); *H05B 37/02* (2013.01)
USPC ..... 315/192; 315/312; 315/294

(58) Field of Classification Search
USPC ..... 315/191, 192, 294, 297, 307, 312
See application file for complete search history.

(56) References Cited

U.S. PATENT DOCUMENTS 5,138,310 A 8/1992 Hirane
5,399,940 A 3/1995 Hanna
6,288,497 B1 * 9/2001 Chang et al. ..... 315/185 R
6,734,639 B2 5/2004 Chang
7,221,044 B2 5/2007 Fan
7,317,403 B2 1/2008 Grootes
7,375,476 B2 5/2008 Walter
7,417,259 B2 8/2008 Sakai
7,439,945 B1 10/2008 Awalt
7,646,154 B2 1/2010 Kang
7,649,326 B2 1/2010 Johnson
7,667,237 B2 2/2010 Sakai
7,688,002 B2 3/2010 Ashdown
7,936,135 B2 5/2011 Hum
8,089,217 B2 1/2012 Hum
8,106,599 B2 * 1/2012 Radermacher et al. ..... 315/291
8,148,905 B2 * 4/2012 Miskin et al. ..... 315/185 R
2002/0175826 A1 11/2002 Hutchinson
2012/0299490 A1 * 11/2012 Lee et al. ..... 315/191

* cited by examiner

*Primary Examiner* — Don Le

(57) ABSTRACT

An optimum LED lighting fixture and regulation method are disclosed for reconfigurable LED arrays used for general illumination applications in AC utility power systems. The method describes a double reconfiguration scheme of a plurality of LED arrays connected in parallel, and where each array comprises some LED pairs formed with two branches of LED lamps capable of changing their interconnection. The first reconfiguration comprises changing the interconnection of the LED pairs to either parallel or series, and the second, comprises changing the number of active LED arrays within the plurality. The method comprises changing the number of active LED arrays as a way of having the magnitude of the current through said plurality to follow the magnitude of the applied voltage. The performance deficiencies of the prior arts are overcome by proposing and LED lighting fixture with higher energy efficiencies, higher power ratings, and lower harmonics generation. In addition, the simplicity of the concept allows for high degree of integrations that can make practical the implementation of driverless LED lighting fixtures.

20 Claims, 7 Drawing Sheets

RECONFIGURABLE LED ARRAYS AND LIGHTING FIXTURES

CROSS REFERENCE TO RELATED APPLICATIONS

This application claims priority from, and incorporates by reference the entirety of, U.S. Provisional Patent Application Ser. No. 61/587,106, filed on Jan. 16, 2012, and Regular patent application Ser. No. 13/682,330, filed on Nov. 20, 2012.

BACKGROUND

1. Field

This invention relates to lighting devices used for general illumination purpose and constructed based on solid state devices such as Light Emitting Diodes better known as LED, which comprise LED arrays and electronic driving circuits enclosed in housings.

2. Prior Art

The use of LED lamps is a trend that continues and as the technology matures, it is expected that LED lamps will be the predominant source of artificial light for general illumination applications. LED lamps are robust solid state devices capable of lasting 50,000 hours or more of operation. The main electrical components of existing LED lighting fixtures are the LED module having the LED lamps organized in arrays and an electronic driver. Existing LED drivers are complex devices used to condition the voltage and current applied to the LED arrays based on high frequency switching of power electronic components. Because of the complexity of these drivers, they are usually the weakest link of an LED lighting system that severely limit the expected life and power ratings of the existing LED fixtures.

Existing LED drivers work by conditioning the input voltage to meet specific parameters of the LED arrays having a fixed configuration. Consequently, existing LED fixtures require a complex and frequently expensive electronic driver in order to adjust the applied voltage source to the electrical demand of a fixed LED array. Popular technologies used for manufacturing existing LED drivers are the PWM, and the buck and boost converters. The main drawbacks of these topologies are their high operating frequencies and the bottleneck limitation of supplying the electric power through a single electronic switching component. The high frequency switching allows for the use of smaller driver components facilitating the integration in a single package. However, the high frequency switching of power electronic devices, such as transistors, imposes a design burden and strict limitations on the maximum electrical power that can be delivered to the LED arrays. Furthermore, in addition to curtailing the power ratings of the LED lighting fixtures, existing driver topologies suffer from undesirable generation of electromagnetic noise, line power harmonics, low power factors, and low energy efficiencies among others.

There have been several attempts to use reconfigurable LED arrays as a way of controlling the power flow through the arrays but they have proved to be not practical and of low commercial value. For instance, the concept for using reconfigurable LED arrays is disclosed in the U.S. patent application No. 2002/0175826 A1 published on Nov. 28, 2002. This patent described a traffic light using reconfigurable LED arrays as a way of changing the array voltage rating to adjust to the power supply voltage fluctuations. As the voltage of the power supply decreases, sections of the LED array are turned off or bypassed by electronic transistors which in turn lower the voltage rating of the LED array, and vice versa. The problem with this concept is that it still uses complex electronic components and functions such as PWM to control the power flow, and when the magnitude of the applied DC voltage is lower than the rating of the array voltage some LED lamps of the array remain off, making it not suitable for portable DC applications using batteries. When the applied voltage falls below the array knee voltage, this concept does not provide a way for reconfiguring the array such that all lamps stay lit resulting in degraded illumination performance.

Another prior art disclosing reconfigurable LED arrays is the U.S. Pat. No. 7,936,135 B2 awarded on May 3, 2011. In addition to turning on and off sections of the LED arrays, this prior art also proposes changing the series-parallel connection of the LED lamps in the array. However, the solution proposed in this patent is still not practical and of low commercial value. For instance when the proposed regulation scheme maintains a constant current, some of the LED lamps are turned off as illustrated in FIGS. 1, 2, 3, 5, 6, 7, 8, and 9 of the patent. This concept is similar to the 2002 patent application mentioned above and it also suffers from the same lighting regulation problems. On the other hand, when the regulation scheme is to maintain lit all LED lamps within the array, the array current vary in a wide range as illustrated in FIGS. 4A, 4B, 4C, and 4D of the patent, generating high harmonics content and poor power factors. Furthermore, because the complexity of the driver increases with the number of LED lamps forming the array, this concept is not practical for higher number of LED lamps.

In addition to the complexity of the drivers, because the responses of the above reconfigurable LED arrays are either a constant current or currents that change wildly, the proposed LED lighting fixtures of the prior arts are considered not lineal. When these LED fixtures are connected to AC utility voltages, considerable amount of harmonics are generated.

There is a market need for a simpler LED lighting fixture having superior lighting and electrical performances at AC utility voltages with a minimum amount of electronic components for integration in a single package while maintaining higher efficiencies and life expectancies at a lower cost. There is a need for a simpler LED fixture design that allows for higher power lighting fixtures with a minimum line harmonics generation.

SUMMARY OF THE INVENTION

The proposed LED lighting apparatus comprises a plurality of LED arrays containing LED pairs, where each array is capable of adjusting its voltage rating by reconfiguring the connection of the LED pairs, and the inventive concept comprising in changing the number of conducting arrays as a way of adjusting the magnitude of the current flowing through said plurality. That is, the inventive concept comprises two stages, the reconfiguration of the LED pairs within the array and the variations of the number of conducting arrays. When the changes in the number of acting LED arrays follow the magnitude of the applied AC sinusoidal voltage, the resultant current is substantially sinusoidal and with the same fundamental frequency as the applied voltage, minimizing the harmonics generation into the power line. Moreover, the generation of harmonics decreases as the power of the LED fixture increases, making more lineal the response of the LED arrays to an applied AC utility voltage. In addition to a lineal response, the advantages of the proposed inventive concept are simpler construction of the LED lighting fixtures, higher reliability thanks to the elimination of the complex high frequency drivers, smaller housings, and the potential for integrating the driver control functions with the LED pairs allowing for driverless solid state lighting fixtures.

DETAILED DESCRIPTION OF THE INVENTION

The deficiencies of existing LED drivers directly connected to AC utility voltages are overcome by using two reconfigurable stages, first, the interconnection of pairs of LED lamps can be changed to adjust the voltage rating of each LED array, and second, the number of conducting arrays can be adjusted to modulate the total current flowing into the lighting fixture. By using the LED lamps to adjust the voltage rating of each array, the on lime of the LED lamps within the arrays increase, which substantially improves the illumination performance of the LED fixtures. The voltage rating 'Vda' of an array can be defined as the voltage applied to the LED array that produces an array current within the allowable range. The voltage rating of an array is slightly higher than the array knee voltage 'Vka'.

For simplicity sake, the variations of the LED parameters with temperature will not be considered. This assumption can be acceptable for arrays having a higher number of lower power LED lamps distributed in a larger area as opposed to a single high power LED lamp.

Figure 1:
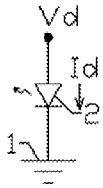
FIG. 1 depicts a graphical representation of an LED lamp.
Figure 2:
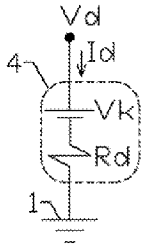
FIG. 2 illustrates the electrical model of the LED lamp shown in FIG. 1.
Figure 5:
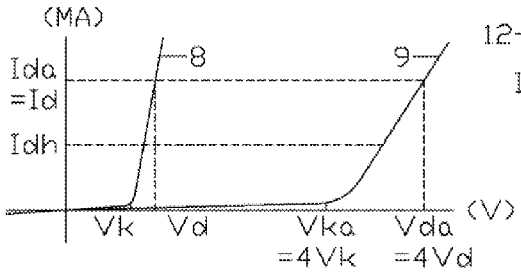
FIG. 5 represents a composite current-voltage plot of the curves corresponding to the LED lamp shown in FIG. 1 and the array shown in FIG. 3.

FIG. 1 shows the symbol used for a typical LED lamp 2. The negative terminal of the LED voltage 'Vd' is connected to the ground terminal 1. The equivalent electrical circuit 4 of an LED lamp 2 is illustrated in FIG. 2. The curve 8 shown in FIG. 5 represents a typical plot of the forward current 'Id' versus the voltage 'Vd' of the LED lamp 2. The battery models the LED knee voltage 'Vk' and is considered not to be influenced by the LED forward current 'Id'. Curve 8 indicates that when the applied voltage 'Vd' is lower than the knee voltage 'Vk', no substantial current flows through the LED lamp 2. The forward voltage 'Vd' is the sum of the knee voltage 'Vk' plus the increment voltage 'ΔVRd' which is the voltage drop across the internal resistance 'Rd' due to the flow of the forward current 'Id'. At rated forward current 'Idr', the rated voltage 'Vdr' across the LED lamp 2 is approximately equal to $Vdr=Vk+\Delta VRdr=Vk+Idr*Rd$. The high sensitivity of LED lamps due to variations in the applied voltage is indicated by the high slope of the curve 8 and it can be estimated as 1/Rd, approximately. 'Idh' represents the current half value of the LED lamp 2, $Idh\approx Id/2$ and corresponds to an LED voltage of 'Vdh' for which the LED brightness is about 50%.

Figure 3:
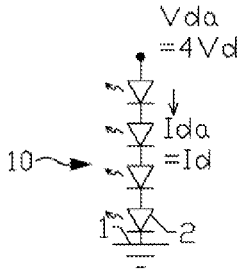
FIG. 3 illustrates an array formed with four LED lamps.
Figure 4:
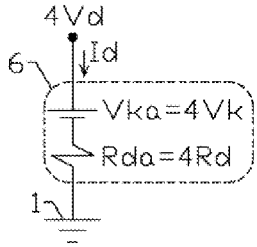
FIG. 4 shows the equivalent circuit of the LED array shown in FIG. 3.

FIG. 3 shows an array 10 consisting of four LED lamps 2 connected in series, and FIG. 4 depicts its equivalent electrical circuit 6. The LED lamps 2 of the array 10 are considered static because they have a fixed configuration. The array 10 knee voltage 'Vka' and the forward resistance 'Rda' are now four times larger than the values corresponding to a single LED lamp 2 shown in FIG. 2. Curve 9, shown in FIG. 5, is a plot of the array current 'Ida' versus the total voltage 'Vda' applied to the array 10. No substantial current 'Ida' can flow through the LED array 10 if the applied voltage 'Vda' is less than four times the knee voltage 'Vk' of an individual LED lamp 2, that is, if $Vda<4Vk$, then $Ida\approx 0$. The array forward resistance 'Rda' is about four times larger than the forward resistance 'Rd' of a single LED lamp 2, and the slope shown in curve 9 is approximately smaller by a factor of four, that is $1/Rda\approx 1/(4Rd)$. In other words, the higher the number of LED lamps 2 within the array, the less sensitive the array current 'Ida' becomes to changes in the applied voltage 'Vda'. This is a fact that had not been exploited to its full potential by existing prior arts. Because of the limitations of the high frequency drivers at higher voltages, the tendency of the present technologies is to increase the power of each LED lamp while decreasing their number within the array. Among others, two major disadvantages of this tendency are an increase of the heat management issues due to higher power densities and a worse light distribution due to a single point light source.

Figure 6:
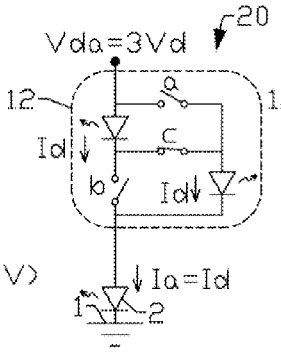
FIG. 6 illustrates an array with an LED-pair configured in series state.
Figure 7:
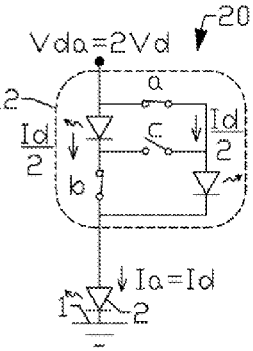
FIG. 7 illustrates an array with an LED-pair configured in parallel state.

FIG. 6 and FIG. 7 illustrate an LED array 20 consisting of a static LED lamp 2 and an LED-pair 12. The LED lamps of the LED-pairs 12 can be considered dynamic LED lamps because they are capable of changing their interconnection from series to parallel and vice versa, as opposed to the static LED lamp 2. FIG. 6 shows the LED-pair 12 configured in series state. The LED-pair 12 is in series state when switch 'c' is closed and switches 'a' and 'b' are open, making the LED pair voltage equal to 2Vd. When the LED-pair 12 is in series state, the voltage of the array 20 is equal to 3Vd and the current flowing through each LED lamp of the pair 12 is equal to the array current 'Ida'. FIG. 7 shows the LED-pair 12 configured in parallel state. The LED-pair 12 is in parallel state when switch 'c' is open and switches 'a' and 'b' are closed, making the LED pair voltage approximately equal to 'Vdh'. When the LED-pair 12 is in parallel state, the voltage of the array 20 is approximately equal to 2Vd. The current flowing through each LED lamp of the pair 12 is now equal to approximately 50% of the array current 'Ida'. Notice that the current of the array 'Ida' is always equal to the current flowing through the static LED 2 located at the bottom. The regulation of the current, voltage, and illumination levels of the array 20 with a single static LED lamp 2 is poor. For example, their values can fluctuate up to 40%.

As the number of LED lamps increases within the array 20, the regulation performance improves dramatically. The LED-pair 12 represents the optimum regulation scheme for reconfigurable LED arrays. When changing the state of an LED-pair 12, the array knee voltage 'Vka' changes by the minimum amount of ±Vd, approximately. The brightness of an LED-pair 12 changes by 50% approximately, while a change of the brightness of the array is barely noticeable. If the DC voltage applied to the LED array contains 60 Hz ripples, the LED-pairs 12 are turned on and off at a rate of 120 times per second, which cannot be perceived by the human eye. Furthermore, there are additional advantages for using low frequency drivers in terms of higher efficiencies and lower design complexity, noise generation, and production cost.

The LED-pair 12 can be extended to have three branches of LED lamps 2 configured in an LED-triple module (not shown). The LED-triple can be capable of reconfiguring their three branches of LED lamps in series, parallel, or a combination of a series-parallel connections; changing the voltage rating of the LED-triple to Vd, 2Vd, and 3Vd, approximately. However, the complexity of the control circuit driving the LED-triple increases considerably, and the illumination performance of the array is also negatively affected because some LEDs can be driven at currents lower than 33% of the array rated current.

For simplicity sake, the embodiments are shown with the switching components being performed with mechanical switches, however, it is understood that the actual construction will be implemented by using electronic switching devices such as MOSFETs, BJTs, IGBTs, and FETs among other electronic devices capable of implementing the switching function.

Figure 8:
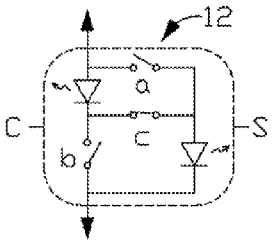
FIG. 8 illustrates an LED-pair with a control and an output lines.

As already stated, the LED pair 12 can be formed with two branches having each an LED lamp, and where the branches are capable of changing their interconnection and be reconfigured in either series or parallel as determined by the states of the switching devices 'a', 'b' and 'c'. The states of the switching devices 'a', 'b', and 'c' of the LED-pair 12 can be changed with a single control line 'C' as illustrated in FIG. 8. This function can be implemented by replacing the mechanical switches 'a' and 'b' with enhancement mode MOSFETs and switch 'c' with a depletion mode MOSFET. In this way the gates of the MOSFETs within an LED-pair 12 can be logically tight together to a single control line. When using a single control line 'C', the default state of the LED-pairs 12 is series because the state of the depletion mode MOSFET represented by the switch 'c' is low impedance when no power is applied, while the state of the enhancement mode MOSFETs represented by the switches 'a' and 'b' is high impedance (or open circuit). As a consequence, the LED-pair 12 can be configured in series when the status of the control line 'C' is logic low and configured in parallel when the status of the control line 'C' is logic high. The default stale of this LED-pair 12 can also be considered fail safe since the array containing such LED-pairs 12 presents its highest impedance when initially connected to a voltage source, exposing the LED lamps within the array to the minimum current when the control lines are not yet stable due to initialization time delays within the control circuit. The LED-pair 12 can also be furnished with an output line 'S' for status indication and control function, transmission. For example, the line 'S' can be electrically connected to the control line 'C'.

Figure 9:
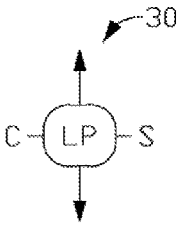
FIG. 9 illustrates the LED-pair shown in FIG. 8 integrated in a single module.
Figure 10:
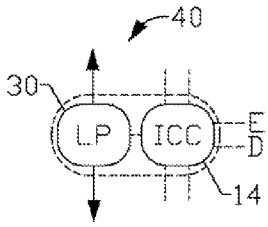
FIG. 10 illustrates the LED-pair module shown in FIG. 9 integrated with some control functions in a single module.

The LED-pair 12 shown in FIG. 8 can be integrated in a single LED-pair module 30 shown in FIG. 9. Module 30 can ease the construction of the solid state lighting fixtures and increase their productivity. The driver required to control an LED array using LED modules 30 can be further simplified if more control functions are integrated with the LED-pair units. FIG. 10 illustrates an LED-pair module 40 where the Integrated Control Circuit 14 includes some decision making functions for the reconfiguration of the LED-pair 30. The module 40 is capable of transmitting its status to and reading the status from the neighbor modules 40 located above and below. The module 40 can also have two more inputs: the enable 'E' and the directional 'D' inputs. The control lines 'ED' can be the output of a circuit that determines if the array current 'Ida' is outside an allowable range. When the enable line 'E' is logic '0', for example, the array rated current 'Ida' is within permissible values and the actual configurations of the LED-pairs 12 within the modules 40 do not change. When the array current 'Ida' is outside the allowable range, the enable line is set to logic '1'. Then, the states of the module 40 can change based on the states of the modules 40 located immediately above and below, and the state of the control line 'D'. The control line 'D' can be set to logic '0' for example, when the array current 'Ida' is below the allowable range, and to logic '1' when the array current 'Ida' is above. The actual state of a module 40 does not change when the states upper and lower modules 40 are the same. On the other hand, if the states of the neighbors modules 40 are not equal, the present state of a module 40 can either change to series if the control line 'D' is set to logic '1', or to parallel if the control line 'D' is set to logic '0'. The control line 'D' can be thought as a directional function that indicates if the array current 'Ida' is either increasing or decreasing outside the allowable range. The enable input 'E' can also be used as a safety function that can disable the LED array during the control initiation time and when the applied voltage has raised to dangerous levels.

Figure 11:
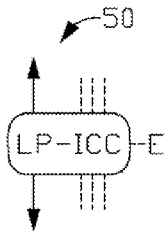
FIG. 11 shows the LED-pair of FIG. 10 with integrated current sensing functions.

The function 'D' can also be integrated with the LED-pair in a single module 50 shown in FIG. 11. If needed, the module 50 can have current sensing capabilities and can be furnished with control lines to broadcast or receive the function 'D' to other LED-pair modules located above and below. When the LED-pair module 50 is used to construct the LED array, a minimum amount of external driver components is required.

Figure 12:
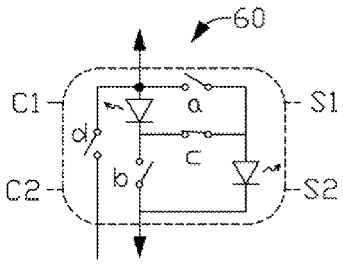
FIG. 12 shows the LED-pair of FIG. 8 with two control lines.
Figure 13:
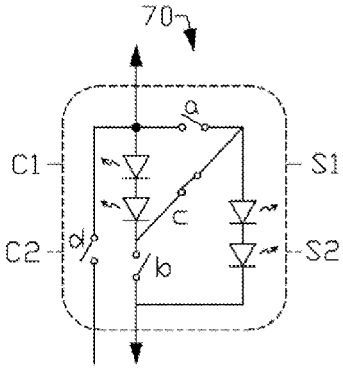
FIG. 13 shows another LED-pair of FIG. 12 having two LED lamps per branch.

Additional embodiments of the LED-pair 12 can have more than one control line. FIG. 12 and FIG. 13 illustrate embodiments of the LED-pair modules 60 and 70 having two control lines 'C1' and 'C2' to select one of four possible states such as high impedance (or open circuit), zero impedance (or short circuit), parallel, and series. The parallel and series states are similar to those already described for the LED-pair 12 shown in FIG. 8. In high impedance state, all switching devices 'a', 'b', and 'c' are open. In zero impedance state, all switching devices 'a', 'b', and 'c' are closed. The switching element 'd' is used as a bypass device and it only closes for the zero impedance state providing a bypass with only one switching element instead of three. Moreover, the LED-pair 12 can have more than one LED lamp per branch. FIG. 13 illustrates an embodiment of an LED-pair module 70 comprising two LED lamps per branch. The current rating of the module 70 is the same as the LED-pair 12. However, the voltage rating is about 2Vd when configured in parallel, and 4Vd when configured in series. As previously shown for the LED-pair 12, the modules 60 and 70 can also have two output lines 'S1' and 'S2'. The control lines 'S1' and 'S2' can be electrically connected to the control lines 'C1' and 'C2' respectively. 'S1' and 'S2' can be used to transmit the status of the control lines 'C1' and 'C2' to other modules located within the same level.

Figure 14:
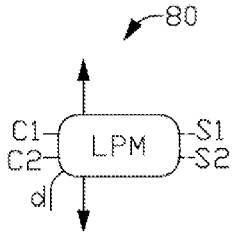
FIG. 14 illustrates the LED-pair of FIG. 12 integrated in a single module.
Figure 15:
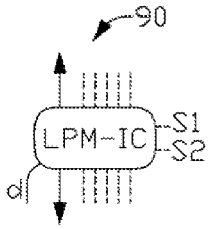
FIG. 15 shows the LED module of FIG. 14 with integrated control and current sensing functions.

The LED-pair module 80 shown in FIG. 14 can represent a simplified legend of the modules 60 and 70 shown in FIG. 12 and FIG. 13, respectively. The LED-pair module 90 shown in FIG. 15 represents the LED-pair module 80 with additional integrated control functions such as current sensing for the directional function 'D' and other input/output functions for reading the stales from and broadcasting the state to the neighbor modules located above and below. The control lines 'S1' and 'S2' have the same function as explained above for modules 60 and 70. The control lines shown for the modules refer to the control functions and do not necessarily account for the number of physical connections required to implement the inventive concept. The exact number of physical connections depends on the design and the type of technology of the components being used, for example, analog, digital, etc.

Figure 16:
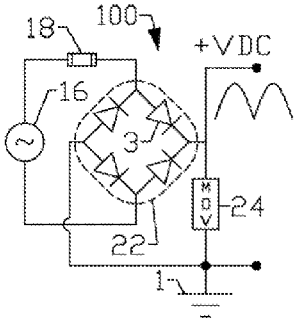
FIG. 16 depicts a typical power supply.

FIG. 16 depicts a typical power supply 100 used as an AC-to-DC converter. The AC utility voltage source 16 is converted to a full wave rectified DC voltage +VDC by the bridge rectifier 22. The fuse 18 can protect against current overloads while the metal oxide varistor 24 can protect against momentary line over voltages or transients. The power supply 100 generates the voltage +VDC required by the LED arrays.

Figure 17:
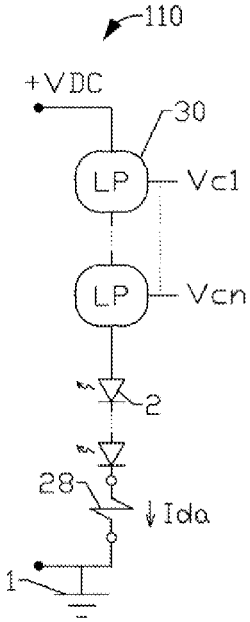
FIG. 17 illustrates an LED array formed with some LED pair modules as shown in FIG. 9.

The LED array 110 shown in FIG. 17 comprises a string of static LED lamps 2 and dynamic LED lamps represented by the LED-pair modules 30. A shunt resistor 28 can be added to monitor and control the current 'Ida' flowing through the array 110. The configuration of the LED-pair 30 can be done by the control lines 'Vc1' through 'Vcn' The lowest impedance of the LED array 110 happens when the state of all LED-pair modules 30 is parallel, while the highest array impedance occurs when the state of all modules 30 is series. The current regulation of the array 110 is performed in the following manner: when the voltage +VDC applied to the array increases, the number of modules 30 connected in series is increased accordingly to maintain the array current within the allowable range, and when the applied voltage +VDC decreases, the number of modules 30 connected in parallel is increased to keep the array current within the allowable range.

Figure 18:
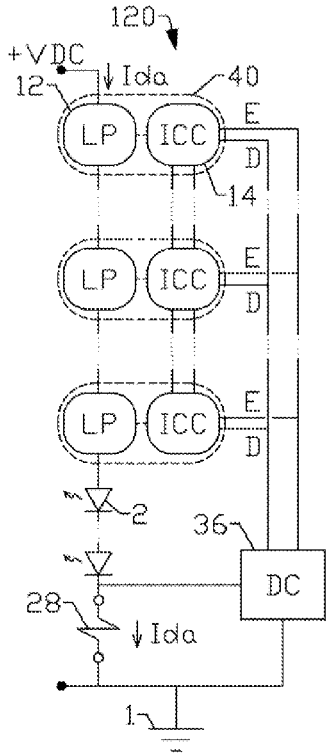
FIG. 18 illustrates an array formed with some LED pair modules as shown in FIG. 10.

The control lines 'Vcn' can be eliminated by integrating some control functions with the LED-pair modules. FIG. 18 illustrates an LED array 120 having some LED-pair modules 40. The Integrated Control Circuit 14 can read the states from and transmit its state to the modules immediately located above and below. When the enable line 'E' is active, the configuration of the module 40 changes based on the states of its neighbor modules and the status of the directional line 'D'. For instance, if two neighboring modules, say modules 8 and 10, have the same state, the state of the module 9 does not change. On the other hand, if the states of the neighboring modules 8 and 10 are not the same, then, the state of the module 9 can either change to series when the status of the directional control line 'D' indicates an increasing array current, or otherwise, the state of the module 9 can change to parallel when the status of the directional control line 'D' indicates a decreasing array current. Note that the array 120 formed with LED-pair module 40, only requires two external control lines, 'E' and 'D'.

Figure 19:
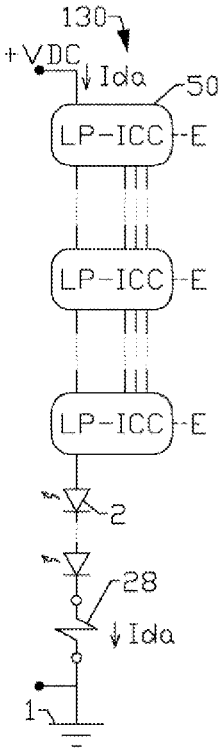
FIG. 19 illustrates an array formed with some LED pair modules as shown in FIG. 11.

The number of control lines can be further minimized if the directional function 'D' is integrated with the LED-pair modules. FIG. 19 illustrates an array 130 formed with some LED-pair modules 50. Because the modules 50 have current sensing functions capable of detecting when the array current 'Ida' is either increasing or decreasing, the external directional control line can be eliminated. The control function can be performed by requiring only a module 50 to have current sensing capability 'D' within the array 130. For example, the bottom module 50 of the array 130 can be furnished with current sensing function 'D' that can be transmitted to the other modules 50 located above.

The voltage rating of the LED arrays 110, 120, and 130 is equal to the sum of the knee voltages of the static LED lamps 2 and the knee voltages of the dynamic LED lamps of the modules. As previously explained, the magnitude of the array current 'Ida' is insignificant when the magnitude of the applied voltage is lower than the array knee voltage 'Vka', that is, when +VDC<Vka, then Ida≈0.

Figure 20:
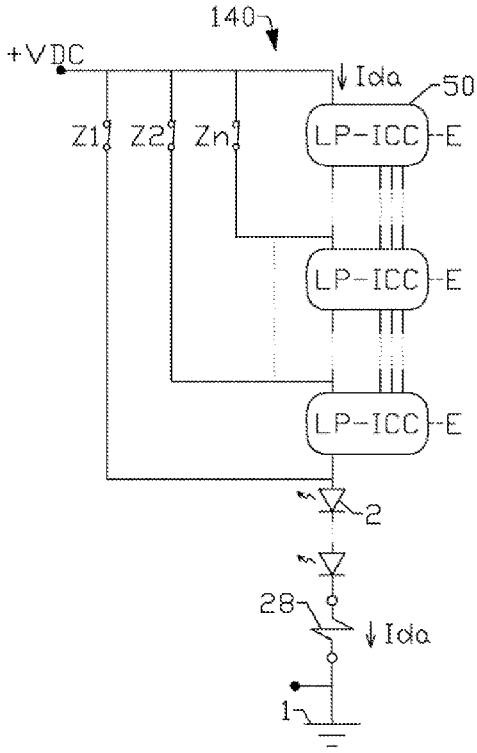
FIG. 20 depicts an array formed with some LED pair modules as shown in FIG. 11 and bypass switching devices.

FIG. 20 shows an embodiment of an LED array 140 where the initial array knee voltage 'Vka' is minimized by providing jumpers to bypass the current away from the LED-pair modules 50. By closing the switching devices 'Z1' through 'Zn', entire sections of the array can be bypassed, which effectively eliminates those array sections. Assume that initially, all switching devices 'Z1' through 'Zn' are closed and all LED-pair modules 50 are set to parallel state. Under this condition, the initial knee voltage 'Vka' of the array 140 is equal to the sum of the knee voltages of the string of static LED lamps 2 located at the bottom. As the applied voltage +VDC increases and passes the knee voltage of the static LED lamps 2, the first array current 'Ida' increases. When the array current 'Ida' increases above the allowable range, the switching device 'Z1' opens, increasing the knee voltage 'Vka' of the array 140 by an amount equal to the knee voltages of the static and dynamic LED lamps contained within zone 1. Further rise of the voltage +VDC increases the array current above the allowable range causing the modules 50 within zone 1 to be reconfigured from parallel to series state, increasing the array impedance and forcing the array current 'Ida' to fall within the allowable range. As the applied voltage +VDC rises further, the array current increases above the allowable range, and the switching device 'Z2' opens, causing the array knee voltage 'Vka' to increase by an amount equal to the knee voltage of the LED-pair modules located within zone 2. The process of opening the switching devices and reconfiguring the modules 50 continue until the last switching device 'Zn'. The reconfiguration of the modules 50 within zone 'Zn' continues until the voltage +VDC reaches its peak value 36. Even though the above describes the reconfiguration of the modules 50 within a zone to be executed as soon as the corresponding switching devices open, the reconfiguration of the modules 50 can also be delayed and start alter the opening of the last switching device 'Zn'.

Figure 21:
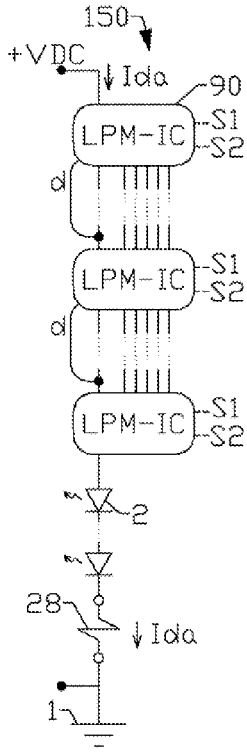
FIG. 21 illustrates an array formed with some LED pair modules as shown in FIG. 15.

Another way for minimizing the initial array knee voltage is to set the status of the LED-pair modules to the zero impedance (or short circuit) state. By setting all LED-pair modules shown in arrays 110, 120, and 130 to the zero impedance state, the initial array knee voltage 'Vka' can be made approximately equal to the knee voltage of the string of static LED lamps 2 located at the bottom of the array. FIG. 21 illustrates an LED array 150 where the internal switching element 'd' of the module 90 is used to bypass the module and any other LED lamps located between the module 90 and the 'd' connection below. The control lines of the modules 90 are interconnected such that a module can read the states from and transmit its stale to the neighbor modules 90 located above and below. The control lines of the top module are connected such that it can read a low impedance state from the expected neighbor module 90 above, and the connection of the control lines of the bottom module 90 is made such that it read a series state from the expected neighbor module 90 below. The last configuration guarantees that when the applied voltage starts increasing from zero, the bottom module 90 changes configuration first, and that when the voltage starts decreasing from its peak value 36, the top module 90 changes configuration first.

Figure 22:
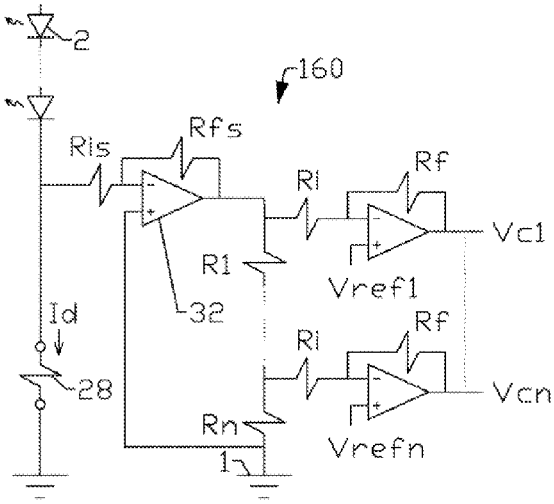
FIG. 22 illustrates a control circuit based on analog devices.
Figure 23:
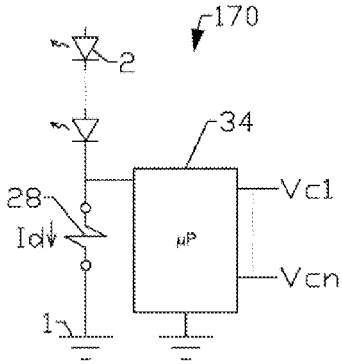
FIG. 23 depicts a control circuit based on a microprocessor unit.

FIG. 22 and FIG. 23 illustrate two possible implementations of the control circuits used to change the states of the LED-pairs forming the LED arrays. The analog control circuit 160 shown in FIG. 22 can be implemented with operational amplifiers 32 or other types of analog electronic devices. The changes of the array current 'Ida' can be amplified and used to activate the control lines 'Vc1' through 'Vcn'. A microprocessor version of the control circuit 170 is shown in FIG. 23. The microprocessor unit 34 can read the changes of the array current 'Ida' and activate the control lines 'Vc1' though 'Vcn' in accordance with the control program stored in the unit 34. The control circuit can also be implemented with other electronic devices, for example, it can be constructed with logic gates only (not shown). The control circuits 160 and 170 can also be designed to monitor the array voltage instead of the current or to accept inputs for other important parameters affecting the performance of the LEDs. For instance, the temperature of the LED lamps can be factored into the control function to improve the overall performance of the LED lighting fixture.

The implementation details of the integrated control circuit and the control circuit driving the LED-pairs are not shown for clarity, it is understood that a person with ordinary skills in the art can design these control circuits when the control specifications are provided in accordance with the intent of the concept being disclosed.

Figure 24:
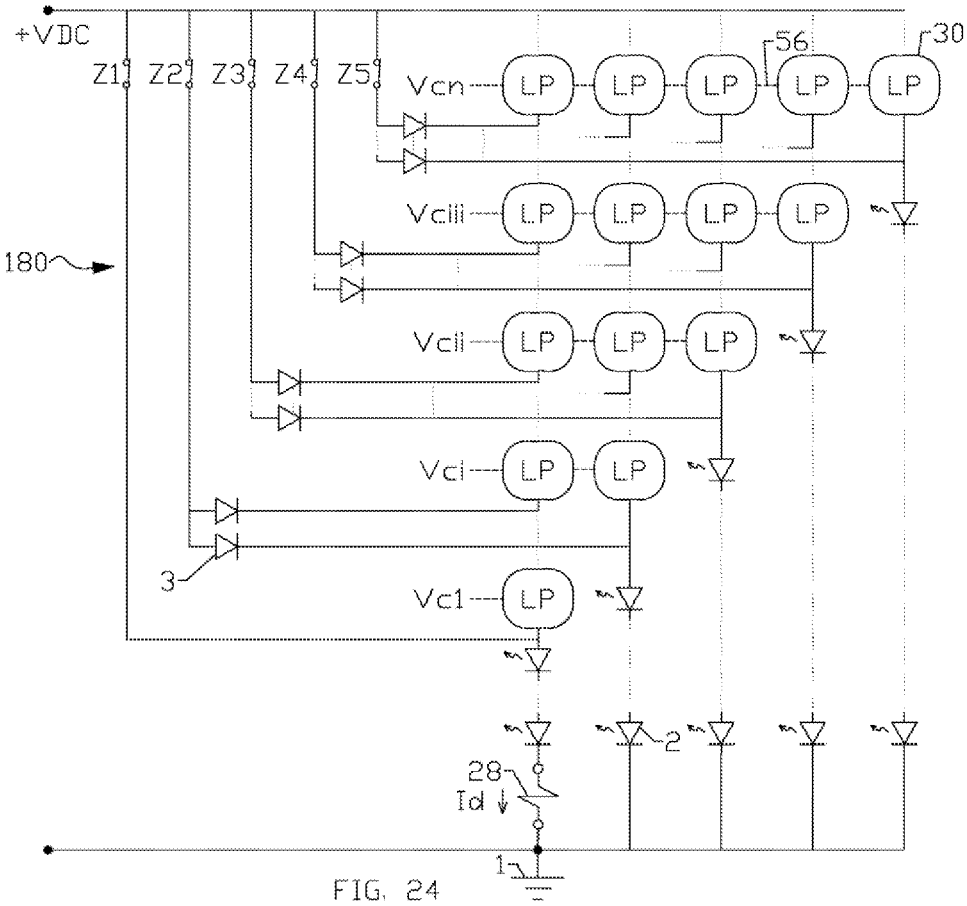
FIG. 24 illustrates a multi-array formed with some LED-pairs of FIG. 9 and some switching devices.

FIG. 24 illustrates an embodiment of a multi-array 180 comprising five LED arrays connected in parallel. The LED arrays are formed by connecting in series a plurality of static LED lamps 2 and a plurality of LED-pair modules 30. The string of static LED lamps 2 of the first array has a lower number of static LED lamps 2 than the second array, and the second array has a lower number of static LED lamps 2 than the third array, and it continues successively until the last array which has the higher number of static LED lamps 2. The multi-array 180 includes five switching devices 'Z1' through 'Z5' that define five zones. In the embodiment shown in FIG. 24 each zone coincides with the top of the string of static LED lamps 2 located at the bottom of the array. As shown in FIG. 24, a switching device is shared among the different arrays. The switching device 'Z5', for example, is shared by all five modules 30 located at level 'n'. The rectifier diodes 3 provide isolation by preventing the load sharing among the arrays. In another embodiment (not shown) a switching device per zone per array is provided eliminating the need for the rectifier diodes 3. The LED-pair modules 30 within a level can be interconnected and controlled from a single control line. For instance, the level 'n' shows five modules 30 interconnected with lines 56 and controlled by 'Vcn'. After an initialization time delay, all LED-pair modules 30 are configured in parallel and all switching elements 'Z1' through 'Z5' are closed making the initial array knee voltage equal to the sum of the knee voltages of the string of static LED lamps 2 located at the bottom of the arrays. As a result, the first array has the lowest array knee voltage.

Figure 25:
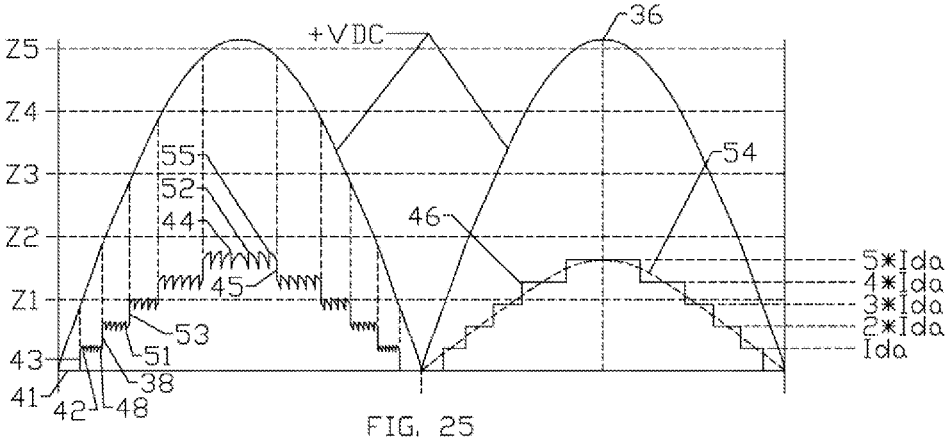
FIG. 25 depicts the total current and voltage waveforms of the multi-arrays as shown in FIG. 24, FIG. 26, FIG. 27, and FIG. 28.

FIG. 25 illustrates the applied voltage and total current waveforms for the multi-array 180 shown in FIG. 24. The figure depicts a uniform voltage distribution among the different zones, but it has not to be the case. For example, the voltage separation between zones 4 and 5 can be larger than the voltage separation between zones 3 and 4, and so on. As implied by the curve 9 shown in FIG. 5, the voltage-current regulation of an LED array is less sensitive to voltage variations as the number of LED lamps connected in series increases. The actual current waveform illustrates the changes in current 42, 44, 48, 51, 52, 55 due to the reconfigurations of the LED-pairs and the current changes 38, 43, 45, 53 due to the variations in the number of active LED arrays. The current waveform 46 represents the stepped average value of the actual current, and the current waveform 54 represents the approximate sinusoidal value of the actual current. The number of current changes due to the reconfiguration of the modules is shown in FIG. 25 for illustration purpose only. In practice, the number of modules can be higher.

As the applied voltage +VDC increases, the input current is negligible 41 until +VDC reaches the knee voltage of the suing of static LED lamps 2 of the first array. When the applied +VDC reaches and passes the knee voltage of the string of static LED lamps 2, the total current flowing into the multi-array 180 increases 43 and is equal to approximately the current 'Ida' flowing through a single array. As the applied voltage +VDC continue to rise, it forces the array current to increase above the allowable range which in turn causes the control circuit to open the switching device 'Z1'. The opening of the switch 'Z1' adds the modules 30 and any other LED lamps located within the zone 1 increasing the array impedance suddenly and forcing the array current 'Ida' to fall 42 within acceptable values. At this point, the LED lamps of the modules 30 within zone 1 are lit below their full brightness because they are configured in parallel and the current of the dynamic LED lamps within the modules is about Ida/2. As the voltage +VDC rises and the array current increases again above the allowable range, the control circuit directs the LED-pair modules 30 located at level 1 to change configuration from parallel to series, which in turn increases the array impedance and forces the array current to fall back within the allowable range. The LED lamps of the modules 90 at level 1 are now driven by the current 'Ida' and are lit to their full brightness. The reconfiguration process continues until the last module 30 within zone 1 has been reconfigured. The current change 48 corresponding to this last reconfiguration is shown in FIG. 25.

As the applied voltage +VDC continue to increase, it reaches and passes the knee voltage of the string of static LED lamps 2 located at the bottom of the second array forcing the current to increase 38. The total current flowing into the multi-array 180 is now approximately equal to twice the current magnitude of a single array, that is 2*Ida. As the current of the array increases above the allowable range, the switching device 'Z2' opens adding to the first and second arrays the static and dynamic LED lamps within zone 2. As a consequence, the impedances of both arrays increase forcing their current to fall back within the acceptable range. At this point, the dynamic LED lamps of the modules 30 within zone 1 and the static LED lamps 2 of the first and second arrays are turned on. Because the dynamic LED lamps of the modules 30 located within zone 2 are still configured in parallel, they are driven at 50% of their rated current and 50% of their full brightness, approximately. As the voltage +VDC continue to increase, the currents of the first and second arrays reach their maximum allowable values. The control circuit, then, directs a level of modules 30 within zone 2 to change configuration from parallel to series which increases the impedances of the arrays and forces their current to fall back within the allowable current range. As the voltage +VDC increases, the process of reconfiguring modules 30 continues until the last module 30 located in zone 2 has been reconfigured in series forcing the current to fall 51 back within the allowable range. After further rise of the applied voltage +VDC, the string of static LED lamps 2 of the third array is turned on and the array currents increase 53. At this point, the total current flowing into the multi-array 180 is 3*Ida. The process of opening the switching devices controlling the zones and the reconfiguration of the modules 30 from parallel to series state continue until the modules of the last zone has been activated and the voltage +VDC has reached its peak value 36. When the last zone is activated, the magnitude of the total current flowing into the multi-array is approximately 5*Ida. In this document, a level refers to a row.

FIG. 25 illustrates the current decrease 44 due to the last reconfiguration of LED-pair modules 30 just before the applied voltage +VDC reaches its peak value 36. At this point, most of the dynamic LED lamps of the modules 30 within zone '5' are connected in series. After reaching the peak value 36, the applied voltage +VDC starts to decrease, forcing the total current to decrease. When the array currents decrease below the allowable range, the control circuit directs a module within zone '5' to change from series to parallel state causing the impedance to decrease in all arrays and forcing the current to increase 52 within the allowable range. The latter process continues until all LED-pair modules 30 within zone 5 have been reconfigured from series to parallel state. As the voltage +VDC continues to fall, the array current decreases again below the allowable range making the control circuit to close the switching element 'Z5' When the switching element 'Z5' closes, it bypasses all static and dynamic LED lamps located within zone 5, which causes the impedance to further decrease in all arrays and forces the array currents to increase 55 within the allowable range. At this point all LED-pair modules 30 within zone 5 have been turned off. As the voltage +VDC continues to fall, eventually the voltage +VDC falls below the knee voltage of the string of static LED lamps 2 located at the bottom of the fifth array, which turns off all LED lamps of the fifth array and forces the total current to decrease 45 to approximately 4*Ida.

As the applied voltage +VDC continue to decrease, the process of sequentially closing the switching devices controlling the zones and reconfiguring the modules 30 from series to parallel state continue, and in the process, the total current falls from 4*Ida to 3*Ida, 2*Ida, Ida, and finally to zero when all arrays have been turned off.

The sketch of the approximate current shown in FIG. 25 illustrates the influence of the reduced voltage sensitivity as the number of LED lamps forming the array increases. During the activation of zone 1, the number of LED lamps connected in series is relatively small corresponding to a higher slope of the current-voltage curve 8 shown in FIG. 5. Therefore, the reconfiguration of the LED-pair modules 30 can be performed at a higher frequency to account for smaller changes of the voltage +VDC. On the other hand and during the activation of the zone 5, the number of LED lamps connected in series is relatively large corresponding to a lower slope of the current-voltage curve 9 shown in FIG. 5. As the number of active LED arrays increases, the reconfiguration of the LED-pair modules 30 can be performed at a lower frequency to account for higher changes of the applied voltage +VDC. Moreover, because a larger number of LED lamps can be reconfigured during the activation of zone 5, the LED-pair module 70 shown in FIG. 13 can be a good candidate for zone 5 modules.

The actual current can be approximated with the sinusoidal current 54 shown in FIG. 25. Assume a conservative error of ±15% for the following calculations. If the rated current of the static and dynamic LED lamps forming the multi-array 180 is Idr=700 ma and the Root Mean Square (RMS) value of the power source 16 shown in FIG. 16 is 120VAC, then, the RMS value of the full wave rectified voltage +VDC is also equal to 120V. The RMS value of the current 54 can be calculated as $(5*700\text{ ma})/\sqrt{2}\approx 2.47$ amps. The input power flowing into the multi-array LED 180 can be estimated as, 120V*2.47 A=296.4 W±45. It can be noted that as the number of LED arrays increases, the time duration of the current steps decreases making the actual array current waveform to belter approach a sinusoid. Therefore, the Total Harmonics Distortion (THD) also decreases. In other words, as opposed to existing driver technologies, the THD of the proposed LED lighting fixture can improve with higher power ratings.

Figure 26:
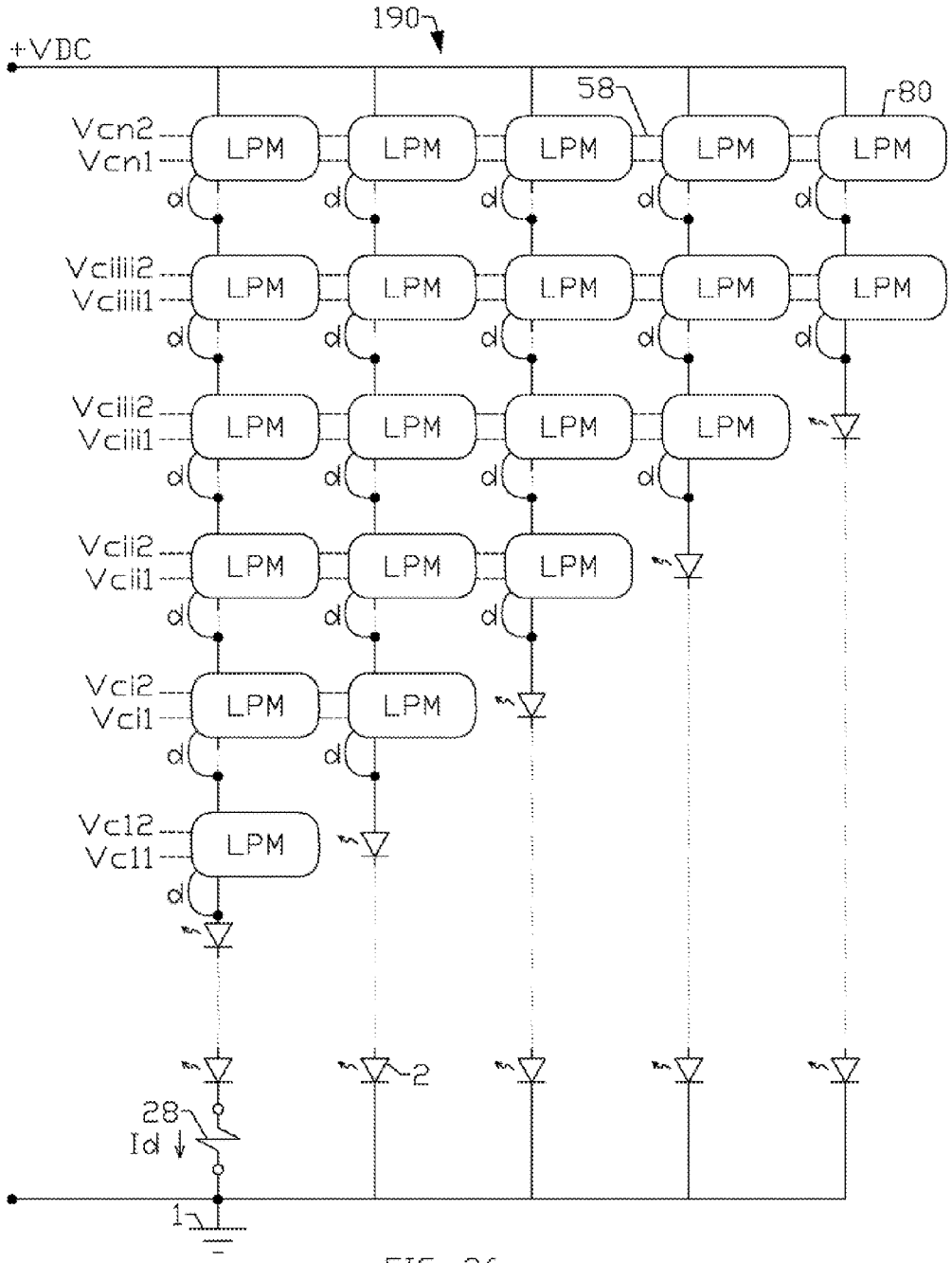
FIG. 26 illustrates a multi-array formed with some LED-pair modules shown in FIG. 14.

FIG. 26 illustrates an embodiment of a multi-array 190 where the external switching elements 'Z1' through 'Z5' has been eliminated. The bypass element 'd' shown in FIG. 12 and FIG. 13 can perform the zone control function of the switching devices shown in FIG. 24. When the bypass element 'd' of the LED-pair module 80 is closed, it can effectively eliminate any static or dynamic LED lamps located between its corresponding module 80 and the 'd' connection below, resulting in a decrease of the impedance and array knee voltage. FIG. 26 shows the 'd' terminal of the bottom modules 80 directly connected to itself. The modules 80 are cascaded such that the modules located within the level can share the same control lines. The status of the control lines 'Vc1' through 'Vcn' are transmitted to all LED-pair modules 80 within the same level by the connecting lines 58.

The operation of the multi-array 190 is similar to the operation already described for the multi-array 180, except that the modules 80 have an additional low impedance state. After a brief initialization time delay, the control circuit configures all LED-pair modules 80 to the low impedance state. Under this condition, the switching element 'd' bypasses any other LED lamps located in between the modules 80 setting the knee voltage of each array equal to approximately the knee voltage of its corresponding string of static LED lamps 2 located at the bottom. Since the first array contains the lowest number of static LED lamps 2, it also has the lowest initial array knee voltage. When the applied voltage +VDC reaches and passes the array knee voltage, the string of static LED lamps 2 of the first array turns on forcing the current to increase 43 to 'Ida'. As the voltage +VDC continues to rise, the array current increases above the allowable range causing the control circuit to activate the control lines 'Vc11' and 'Vc12' to reconfigure all LED-pair modules 80 within level 1 from the low impedance to the parallel state, which in turn increases the array impedance and forces the current of the first array to fall 42 back within the allowable range. As the voltage +VDC continue to rise, the array current increases again above the allowable range causing the LED-pair module 80 of level 1 to be reconfigured from parallel to series state, which in turn increases the army impedance and forces the current to fall back within the allowable range.

As the voltage +VDC keeps rising, the reconfiguration process continue and eventually passes the knee voltage of the string of static LED lamps 2 located at the bottom of the second army and turn them on. The total current flowing into the multi-array 190 increases 38 and is now approximately 2*Ida. Additional increase of the applied voltage +VDC and the array currents cause the control circuit to reconfigure the second level of LED-pair modules 80 from low impedance to the parallel state resulting in an increase of the impedances of the first and second arrays and a decrease of their currents within the allowable range. Again, further rise of the applied voltage +VDC and the array currents cause the control circuit to reconfigure the second level of LED-pair modules 80 from parallel to series state forcing the total current to fall back within the allowable range. As the voltage +VDC increases further, the process of turning on the strings of LED lamps 2 and the reconfiguration of the LED-pair modules 80 continue until the voltage +VDC reaches its peak value 36. The last reconfigured modules 80 prior to the peak voltage 36 cause the current to decreases 44 within allowable range. At this point most of the modules 80 have been reconfigured to series state and the total current is equal to approximately five time the current of a single array, 5*Ida.

As the applied voltage +VDC begins to fall, the array currents decrease below the allowable range causing the control circuit to reconfigure the last level of LED-pair modules 80 from series to parallel lowering the impedance of the arrays and forcing their currents to increase within the allowable range. Further decrease of the voltage +VDC and the array currents cause the control circuit to reconfigure the top level modules 80 from parallel to low impedance state, which forces the array currents to increase back within the allowable range. The modules 80 in low impedance state can bypass any other static and dynamic LED lamps located between the module and the 'd' connection below. As the voltage +VDC and the array currents continue to fall, the reconfiguration of modules 80 continue until the voltage falls below the knee voltage of the string of static LED lamps 2 located at the bottom of the fifth array forcing the current to fall 45 to approximately 4*Ida. At this point, all LED lamps of the fifth array are turned off.

The process of reconfiguring the LED-pair modules 80 and deactivating the LED arrays continue as the voltage +VDC falls, forcing the total current to decrease sequentially from 4*Ida to 3*Ida, 2*Ida. Ida and finally to zero. At this point all static and dynamic LED lamps are turned off and all the modules 80 have been reconfigured to the low impedance state. Even though the above description indicates that the modules 80 are reconfigured in series state when the applied voltage +VDC reaches its peak value 36, some levels of the modules 80 can be last reconfigured to parallel state to provide extra regulation as a safety cushion against transient over voltages.

Figure 27:
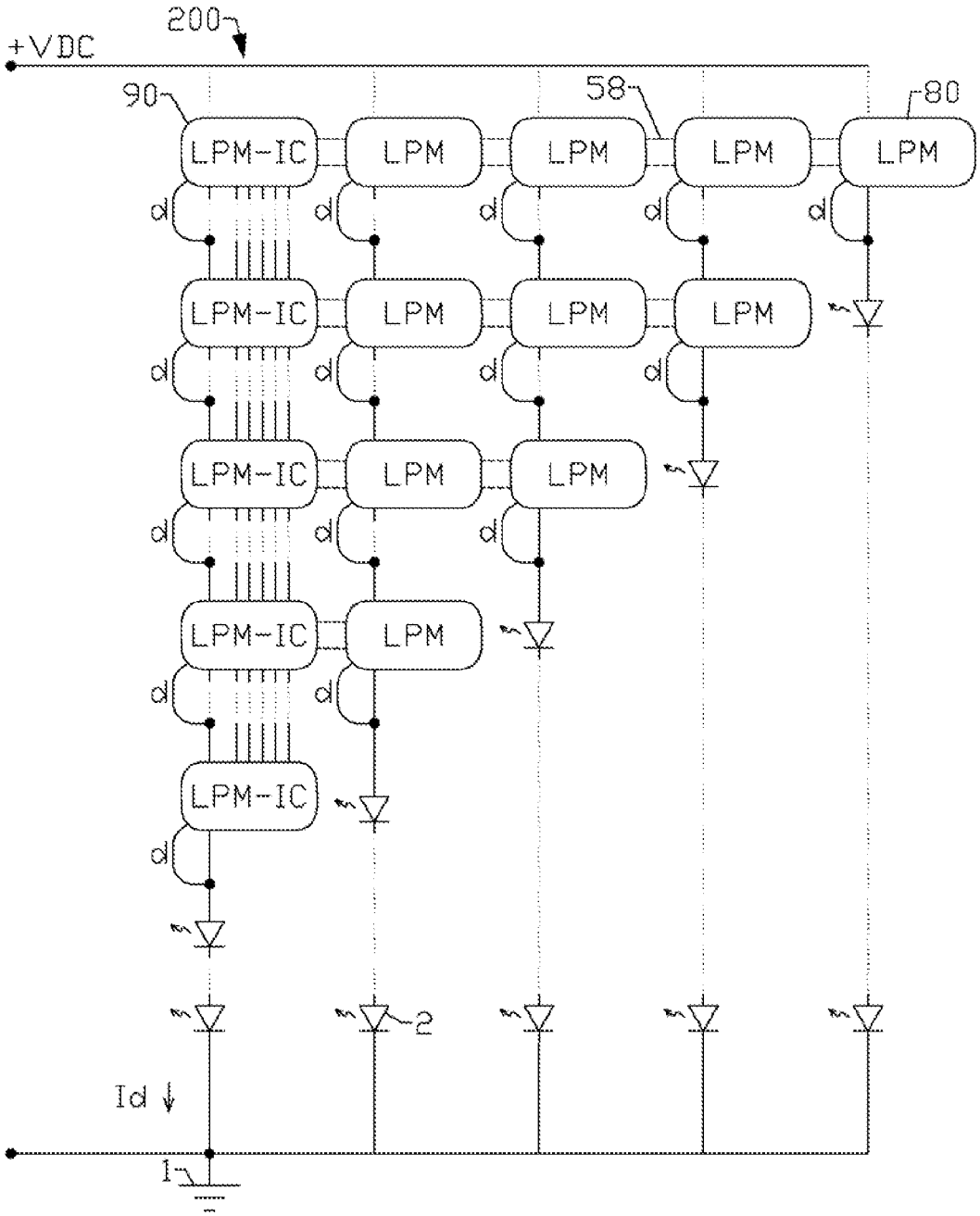
FIG. 27 illustrates a multi-array formed with some LED modules shown in FIG. 14 and FIG. 15.

FIG. 27 shows one embodiment of a multi-array 200 where the control lines 'Vc11' through 'Vcn2' have been eliminated. The multi-array 200 is obtained by replacing the modules 80 of the multi-array 190 with the modules 90 shown in FIG. 15. As previously explained, the LED-pair module 90 includes current sensing capabilities and control functions in a single package. Because the modules 80 of each level are cascaded by the control lines 58 to the modules 90 of the first array, the modules 90 of the first array can generate the control functions and act as a driver for the LED-pair modules 80 forming the other arrays. As a result, the state of the modules 80 within a level corresponds to the state of the modules 90 located on the left.

The operation of the multi-array 200 is similar to that already described for the multi-arrays 180 and 190 except that the reconfiguration process is initialed by the module 90 located within the first array. The approximate waveform of the current for the multi-array 200 is also shown in FIG. 25. After a small initialization time delay, all modules 90 are set to the low impedance state and so are the modules 80 of the other arrays. Under this condition, the first array has the lowest voltage rating which is approximately equal to the knee voltage of the string of static LED lamps 2 located at the bottom. As the voltage +VDC rises above the first array knee voltage, the string of static LED lamps 2 turns on forcing the current to increase 43 to about 'Ida'. As the applied voltage +VDC continue to rise, the array current 'Ida' increases above the allowable range causing the LED-pair module 90 of the first level to be reconfigured from the low impedance to the parallel state, which in turn increases the array impedance and forces the current to fall 42 within the allowable range. Further rise of the voltage +VDC increases the current again above the allowable range, which causes the LED-pair module 90 of the first level to change configuration from parallel to series state and forces the array current to fall back within the allowable range. Eventually, the voltage +VDC rises above the knee voltage of the string of static LED lamps 2 located at the bottom of the second array making the total current to increase 38 to approximately 2*Ida. Further rise of the voltage +VDC and of the array currents cause the modules 90 and 80 of the second level to be reconfigured from low impedance to parallel state, which in turn increases the impedance of the arrays and forces their currents to fall back within the allowable range.

As the voltage +VDC and currents keep increasing, the process of turning on strings of static LED lamps 2 and reconfiguring the modules 90 and 80 from low impedance to parallel state and from parallel to the series state continue, forcing the total current to sequentially increase from 2*Ida to 3*Ida, 4*Ida, and finally to 5*Ida when the voltage +VDC is near its peak value 36. As the applied voltage +VDC begins to fall from its peak value 36, the modules 90 and 80 of the top level start their sequential reconfiguration from series to parallel state, and from parallel to low impedance state, which forces the total current to fall from 5*Ida to 4*Ida, 3*Ida, 2*Ida, Ida and finally back to zero.

Figure 28:
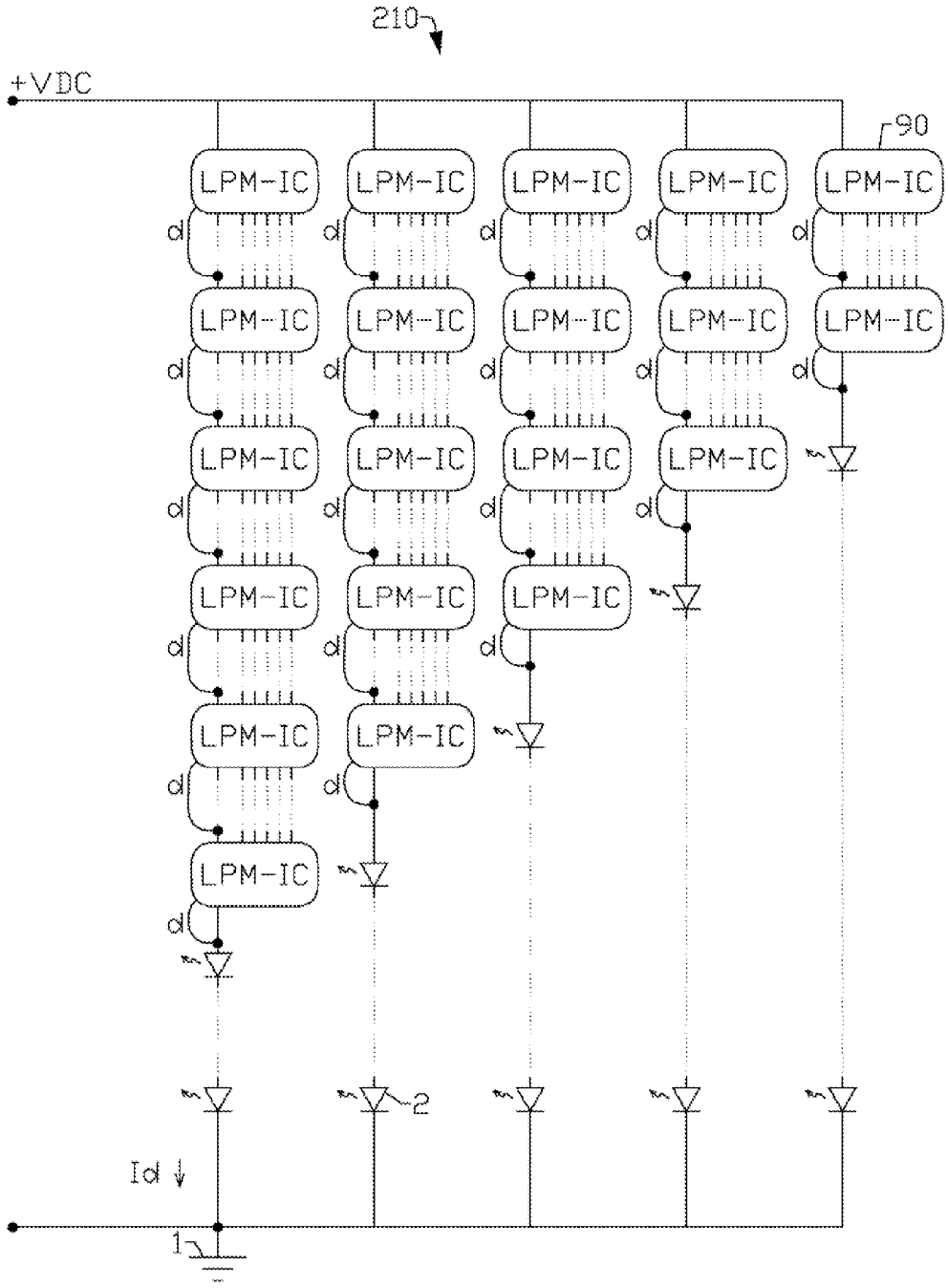
FIG. 28 illustrates a multi-array formed with some LED-pair modules of FIG. 15.

The connecting control lines 58 can be eliminated if the modules 80 shown in FIG. 27 were replaced with modules 90. FIG. 28 shows an embodiment of a multi-array 210 comprising all modules of type 90 and where the connecting lines 58 have been eliminated. The controls of the arrays are independent from each other and they operate in a similar faction as already explained for the multi-arrays 180, 190, and 200. The approximate current generated by the multi-array 210 can also be represented by the total current waveform shown in FIG. 25.

The LED arrays 110, 120, 130, 140 and 150 have been described as formed with discrete parts such as LED-pair modules. However, each array can also be integrated as a single array module (not shown), and a plurality of LED arrays can in turn be integrated in a single multi-array module (not shown). Further more, the LED-pair modules can be grouped together and integrated in a single multi-module device (not shown). The latter can ease the assembly of an LED array since the array can be built by adding a string of static LED lamps 2 to the multi-module part. The latter embodiments (not shown) are direct applications of the disclosed inventive concept and are within the intent of the claims.

This written description uses examples to disclose the invention, including the best mode, and also to enable any person skilled in the art to make and use the invention. The patentable scope of the invention is defined by the claims, and may include other embodiments that occur to those skilled in the art. Such other embodiments are intended to be within the scope of the claims if they have structural elements that do not differ from the literal language of the claims, or if they include equivalent structural/functional elements with insubstantial differences from the inventive concept herein claimed.

What is claimed is:

1. A plurality of LED arrays used for general illumination applications, wherein:

the arrays are connected in parallel;

each array comprises some LED pairs;

each LED pair comprises two branches of LED lamps capable of changing their interconnection; and, said plurality being capable of changing the number of conducting arrays.

2. The plurality of LED arrays of claim 1, wherein each of said LED pairs is integrated in a module.

3. The plurality of LED arrays of claim 2, wherein some modules further comprise control functions that allow for interfacing between said modules.

4. The plurality of LED arrays of claim 2, wherein some of the modules are capable of being reconfigured in more than two different states.

5. The plurality of LED arrays of claim 3, wherein some of the modules comprise a switching element capable of bypassing the LED pairs of said modules.

6. The plurality of LED arrays of claim 2, wherein some of the branches comprise a string of LED lamps.

7. The plurality of LED arrays of claim 1, wherein some of the branches comprise a string of LED lamps.

8. The plurality of LED arrays of claim 1, wherein some of said LED pairs are capable of being reconfigured in more than two different states.

9. The plurality of LED arrays of claim 1, wherein some of the LED pairs comprise more than two branches of LED lamps capable of reconfiguring their interconnections.

10. The plurality of LED arrays of claim 1, wherein some of the LED pairs comprise a switching element capable of bypassing said some LED pairs.

11. A solid state lighting fixture used for general illumination applications, and the fixture comprises:

a plurality of LED arrays connected in parallel;

each LED array comprising some LED pairs;

each LED pair formed with two branches of LED lamps;

the branches of each of said pairs being capable of reconfiguring their interconnection; and, the plurality of LED arrays being capable of changing the number of active arrays.

12. The lighting fixture of claim 11, wherein some of the branches comprise a string of LED lamps.

13. The lighting fixture of claim 11, wherein some of the LED pairs comprise more than two branches of LED lamps capable of reconfiguring their interconnections.

14. The lighting fixture of claim 11, wherein some of the LED pairs comprise a switching element capable of bypassing said some LED pairs.

15. The lighting fixture of claim 11, wherein each of said LED pairs is integrated in a module.

16. The lighting fixture of claim 15, wherein some of the modules further comprise control functions that allow for interfacing between said modules.

17. The lighting fixture of claim 15, wherein some of the modules are capable of being reconfigured in more than two different states.

18. The lighting fixture of claim 15, wherein some of the modules comprise a switching element capable of bypassing the LED pairs of said modules.

19. The lighting fixture of claim 16, wherein some of said LED pairs are capable of being reconfigured in more than two different states.

20. A method for solid state lighting apparatus used in general illumination applications, the apparatus comprises:

a plurality of LED arrays connected in parallel;

each LED array comprising some LED pairs;

each LED pair comprising at least two branches of LED lamps capable of changing their interconnection; and, the method comprising in changing the number of active LED arrays in such a way as to force the magnitude of the current flowing through said plurality to follow the magnitude of the applied voltage.

* * * * *